US010959499B2

(12) United States Patent
Manento

(10) Patent No.: US 10,959,499 B2
(45) Date of Patent: Mar. 30, 2021

(54) STORAGE ATTACHMENT FOR AN ASSISTIVE DEVICE

(71) Applicant: Dominick Manento, Easton, PA (US)

(72) Inventor: Dominick Manento, Easton, PA (US)

( * ) Notice: Subject to any disclaimer, the term of this patent is extended or adjusted under 35 U.S.C. 154(b) by 0 days.

(21) Appl. No.: 16/517,842

(22) Filed: Jul. 22, 2019

(65) Prior Publication Data

US 2021/0022946 A1 Jan. 28, 2021

(51) Int. Cl.

| | |
|---|---|
| ***A45B 1/00*** | (2006.01) |
| ***A61H 3/02*** | (2006.01) |
| *A61H 3/00* | (2006.01) |
| *A45B 3/00* | (2006.01) |

(52) U.S. Cl.

CPC ..... *A45B 1/00* (2013.01); *A61H 3/0288* (2013.01); *A45B 3/00* (2013.01); *A61H 2003/002* (2013.01)

(58) Field of Classification Search

CPC ..... A61H 2003/002; A45B 1/00; A45B 3/10
See application file for complete search history.

(56) References Cited

U.S. PATENT DOCUMENTS

| | | | | |
|---|---|---|---|---|
| 2,210,493 A | | 8/1940 | Lisi | |
| 2,311,049 A | * | 2/1943 | Hedden | A61H 3/02 135/68 |
| 2,750,951 A | * | 6/1956 | Barnwell | A61H 3/02 135/68 |
| 3,545,462 A | * | 12/1970 | O'Mahoney | A61H 3/02 135/71 |
| 4,289,156 A | * | 9/1981 | Ulics | A61H 3/00 135/66 |
| 4,491,257 A | * | 1/1985 | Ingles | A61H 3/00 135/66 |
| 5,056,545 A | | 10/1991 | Spaeth | |
| 5,465,884 A | * | 11/1995 | Bohl | A45B 1/00 135/66 |
| 5,803,327 A | | 9/1998 | Nipper et al. | |
| 6,772,778 B2 | | 8/2004 | Morosini et al. | |
| 7,087,002 B2 | | 8/2006 | Montgomery | |
| 7,174,907 B2 | | 2/2007 | Goldsmith et al. | |
| 2003/0136436 A1 | | 7/2003 | Stepp | |
| 2006/0090783 A1 | | 5/2006 | King-Fai | |
| 2010/0031985 A1 | | 2/2010 | Decesari | |
| 2018/0035769 A1 | * | 2/2018 | Wilber | A45B 3/10 |

* cited by examiner

*Primary Examiner* — Noah Chandler Hawk

(57) ABSTRACT

A device for providing a storage mechanism to an assistive device is presented. The assistive device has a handle, a shaft and a ferrule. The assistive device provides the means for transferring of weight from a person to the ferrule. The storage mechanism, has a frame, a plurality of sides, a bottom and a top. The storage mechanism provides an area storing items while using the assistive device. The device has a coupling means that has a first clip and a second clip. The first clip is coupled to the second clip. Further, the first clip is securely coupled to the assistive device and the second clip is securely coupled to the storage mechanism. The storage mechanism may have a strap, preferably Velcro, that can be used to securely couple the bottom of the storage mechanism to the shaft of the assistive device.

7 Claims, 1 Drawing Sheet

STORAGE ATTACHMENT FOR AN ASSISTIVE DEVICE

FIELD OF THE INVENTION

This invention relates to assistive devices. More particularly, it relates to an attachment for storage with an assistive device.

BACKGROUND

An assistive cane is a walking stick used as a crutch or mobility aid.

Canes can help redistribute weight from a lower leg that is weak or painful, improve stability by increasing the base of support, and provide tactile information about the ground to improve balance. In the US, ten percent of adults older than 65 years use canes, and 4.6 percent use walkers.

In contrast to crutches, canes are generally lighter, but, because they transfer the load through the user's unsupported wrist, are unable to offload equal loads from the legs.

Another type of crutch is the walker, a frame held in front of the user and which the user leans on during movement. Walkers are more stable due to their increased area of ground contact, but are larger and less wieldy and, like canes, pass the full load through the user's wrists in most cases.

Assistive canes and walkers provide much needed support for those with walking disabilities, but it is not easy for one using an assistive cane or walker to also carry items when they are alone. Therefore, there is a need for an assistive device, such as a walker or cane, to have a storage mechanism.

DETAILED DESCRIPTION

Figure 1C:
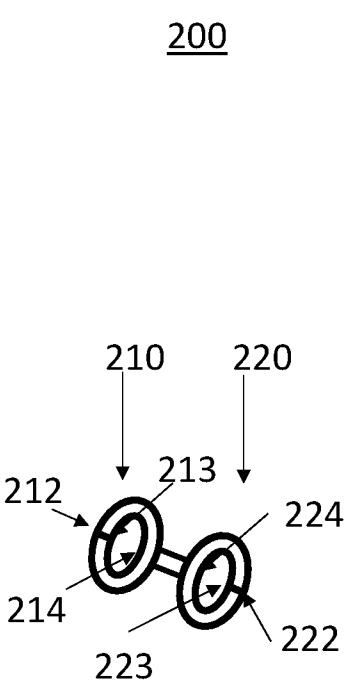
FIG. 1C is an illustrated view of an exemplary coupling device of the storage device shown in FIG. 1B.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Figure 1B:
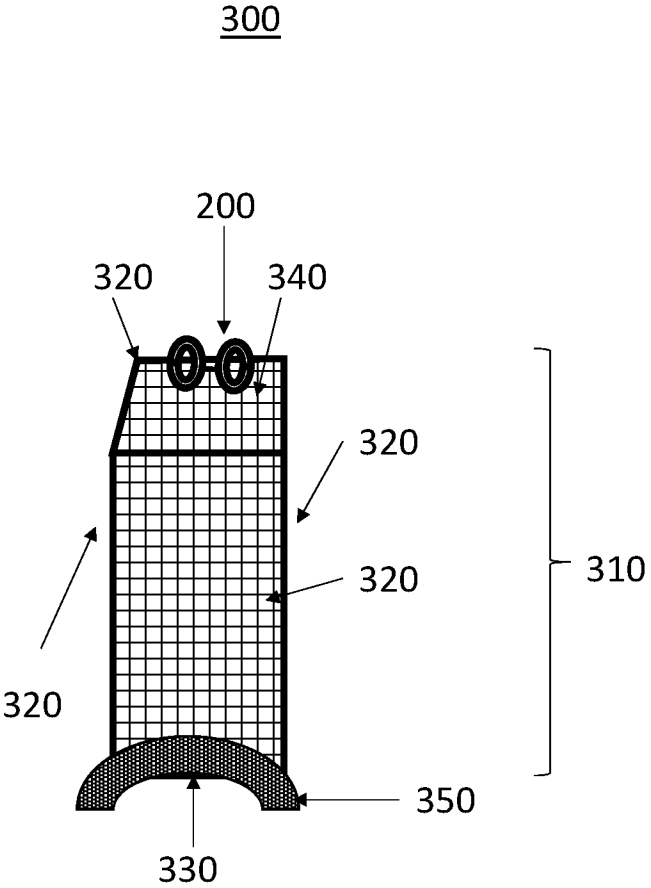
FIG. 1B is an illustrated view of an exemplary storage device.
Figure 1A:
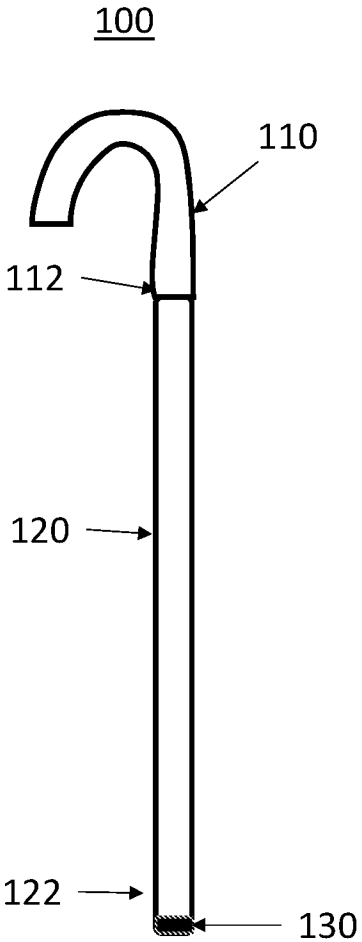
FIG. 1 is an illustrated view of an assistive device.

Referring to FIG. 1A, FIG. 1B and FIG. 1C, an illustrated view of storage mechanism 300 for an assistive device 100 is presented. The assistive device 100 is useful for helping those who have trouble walking or standing to be stable while walking. The assistive device 100 is preferably an assistive cane but can be any type of assistive device like a crutch, walker, etc.

The assistive device 100 has a handle 110, a collar (not shown), a shaft 120, and a ferrule 130.

The handle 110 of the assistive device 100 is useful for a user gripping the assistive device 100 and transferring the load from the user's hand and arm into the shaft of the assistive device 100. The handle 110 is preferably a crook handle, but may be any other style of handle such as a fritz handle, derby handle, etc. The assistive device 100 may preferably be made from wood, but may be aluminum, titanium, etc.

The collar of the assistive device 100 is decorative and may provide a design that a user desires to show.

The shaft 120 of the assistive device 100 transmits the load from the handle to the ferrule 130. The shaft 120 is coupled to a distal end 112 of the handle 110. The shaft 120 may preferably be made of a carbon fiber polymer, but may also be made of metal, composites, or traditional wood. The shaft 120 may preferably be one piece, but may be adjustable utilizing two or more sections.

The ferrule 130 of the assistive device 100 is coupled to a distal end 122 of the shaft 120. The ferrule 130 provides traction and added support when the assistive device 100 is used at an angle. The ferrule 130 is preferably a simple, ridged rubber stopper, but may have a quad end, etc. The ferrule 130 is preferably made of rubber, but may be made of any material which provides a durable, non-slipping surface.

Moving now to FIG. 1B, the storage mechanism 300 has a frame 310, a plurality of sides 320, a bottom 330 and a top 340. The storage mechanism 300 is preferably a basket, but may be any other type of device which can hold items such as a box, a bag, etc. The storage mechanism 300 is preferably a square shape, but may be any other type of shape such as round, rectangular, etc. The storage mechanism 300 is preferably ten (10) inches in height, ten (10) inches in length and three (3) inches in width, but the size of the storage mechanism 300 may be any size that can be attached to the assistive device 100 without causing undue hardship on the user.

The frame 310 of the storage mechanism is preferably made from aluminum, but may be made from wood, steel, titanium, PVC, etc. The frame 310 provides the structural aspects of the storage mechanism 300.

The plurality of sides 320 of the storage mechanism 300 is preferably made from a mesh, but may be made of plastic, may be solid, etc. Each of the sides provides for a barrier from the items stored in the storage mechanism 300 from falling out of the storage mechanism 300.

The bottom 330 of the storage mechanism 300 is a bottom of the frame 310 such that the items being stored in the storage mechanism 300 are prevented from falling through the bottom of the storage mechanism 300. The bottom 330 of the storage mechanism 300 is durable and strong such as a hard plastic, but may be wood, steel, aluminum, etc.

The top 340 of the storage mechanism 300 is open. Thus, the user would place items into and remove items from the storage mechanism 300 through the top 340 of the storage mechanism 300.

The storage device 300 further has a coupling device 200. The coupling device 200, described in more detail in FIG. 1C, is securely and permanently coupled to the side 320 substantially near the top 340 of the storage mechanism 300. The coupling device 200 secures the ferrule 130 of the assistive device 100.

Optionally and/or additionally, the storage mechanism 300 has a strap 350. The strap 350 of the storage mechanism 300 is useful for further securing the storage mechanism 300 to the assistive device 100.

The strap 350 is coupled to substantially near the bottom 330 of the storage mechanism 300. The strap 350 is coupled to the shaft 220 of the assistive device 100 substantially near the ferrule 130 of the assistive device 100. The strap 350 is preferably made of Velcro, but may be made of other materials such as a belt, a plastic tie, etc.

FIG. 1C illustrates a coupling means 200 coupled to the storage mechanism 300 for securing the assistive device 100 to the storage mechanism 300. The coupling means is preferably a clip, but may be any type of coupling means such as Velcro, belt, etc. The coupling means 200 has a first clip 210 and a second clip 220.

The first clip 210 of the coupling means 200 has a gate 212. The gate 212 is useful for providing an opening in the first clip 210 such that it can be attached to or removed from the assistive device 100. Optionally or additionally, the gate 212 has a rubber grip 213 on an inner portion 214 of the gate 212.

The second clip 220 of the coupling means 200 has a gate 222. The gate 222 is useful for providing an opening in the second clip 220 such that it can be attached to or removed from the storage mechanism 300. Optionally or additionally, the gate 222 has a rubber grip 223 on an inner portion 224 of the gate 222. The first clip 210 is communicatively coupled to the second clip 220.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for adding a storage mechanism for an assistive device, the device comprising:

the assistive device having a handle, a shaft and a ferrule, the assistive device for providing transfer of weight from a person to the ferrule;

the storage mechanism, the storage mechanism having a frame, a plurality of sides, a bottom and a top, the storage mechanism for storing items;

a coupling means, the coupling means having a first clip and a second clip, wherein the first clip being coupled to the second clip, wherein the coupling means being for securing the storage mechanism to the ferrule of the assistive device, wherein the first clip of the coupling means has a gate, wherein an inner portion of the gate having a rubber gate, wherein the second clip of the coupling means having a gate, and wherein an inner portion of the gate having a rubber grip; and wherein the first clip being coupled to the assistive device and wherein the second clip being securely coupled to the storage mechanism.

2. The system of claim 1, wherein the storage mechanism being ten (10) inches in height.

3. The system of claim 1, wherein the storage mechanism being ten (10) inches in length.

4. The system of claim 1, wherein the storage mechanism being three (3) inches in width.

5. The system of claim 1, where in the storage mechanism being square in shape.

6. The system of claim 1, further comprising:

a strap, the strap being securely coupled substantially near the bottom of the storage mechanism; and the strap being securely coupled to the shaft of the assistive device.

7. The system of claim 6, wherein the strap being made of a Velcro material.

* * * * *